US008554095B2

(12) United States Patent
Hirabayashi

(10) Patent No.: US 8,554,095 B2
(45) Date of Patent: Oct. 8, 2013

(54) IMAGE FORMING APPARATUS WHICH CONTROLS SETTING OF CONTRAST POTENTIAL

(75) Inventor: Jun Hirabayashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 165 days.

(21) Appl. No.: 13/285,337

(22) Filed: Oct. 31, 2011

(65) Prior Publication Data

US 2012/0128380 A1 May 24, 2012

(30) Foreign Application Priority Data

Nov. 24, 2010 (JP) ..... 2010-261726

(51) Int. Cl.
*G03G 15/00* (2006.01)
*G03G 15/08* (2006.01)

(52) U.S. Cl.
USPC ..... 399/49; 399/53

(58) Field of Classification Search
USPC ..... 399/49, 53
See application file for complete search history.

(56) References Cited

U.S. PATENT DOCUMENTS 6,615,010 B2 9/2003 Hirabayashi et al.
2013/0016988 A1* 1/2013 Tanaka ..... 399/58

FOREIGN PATENT DOCUMENTS

JP 2001-042613 A 2/2001

* cited by examiner

*Primary Examiner* — David Gray
*Assistant Examiner* — G. M. Hyder
(74) *Attorney, Agent, or Firm* — Fitzpatrick, Cella, Harper & Scinto

(57) ABSTRACT

An image forming apparatus, which is capable of bringing an output density close to a target density even if a charge amount of toner particles changes, includes an image forming unit having an image carrier and a developing unit, a storage unit storing a saturation charge amount of toner particles, and a control unit. The control unit forms a patch image using the image forming unit, measures the density of the patch image to obtain a first potential that is a contrast potential corresponding to a target density, estimates the charge amount of the toner particles in the developing unit to obtain a first charge amount, obtains a second potential from the first potential, the first charge amount and the saturation charge amount, and sets the second potential as the contrast potential.

6 Claims, 6 Drawing Sheets

IMAGE FORMING APPARATUS WHICH CONTROLS SETTING OF CONTRAST POTENTIAL

BACKGROUND OF THE INVENTION

1. Field of the Invention

The present invention relates to an image forming apparatus using the electrophotographic technology.

2. Description of the Related Art

An image forming apparatus such as a copying machine or a printer is required to match the output color with a target reference color. Hence, a technique of performing tone conversion so that the output density (color) matches a target density (color), based on the result of actually outputting an image, is widely used. To do this, the image forming apparatus executes tone (color matching) calibration. More specifically, first, the potential/exposure intensity is set such that the solid density matches a target value, and a plurality of patch images with different tones are then printed and output. Next, colorimetry is performed for these patch images to generate a reference tone conversion table according to which the output density (color) matches a target density (color). Printing an image upon correction using the reference tone conversion table allows output corresponding to a target reference density. Note that the plurality of patch images with different tones are printed without correction.

In an image forming apparatus which forms an image using toner particles, the amount of development, that is, the amount of toner used to form an image changes due to a change in charge amount of toner particles. This change adversely affects a wide range of tones. This effect becomes conspicuous especially in an image forming apparatus which uses toner particles and carrier particles as a developer, and fills an electrostatic latent image with toner in accordance with the charge amount of toner, thereby forming an image.

To suppress changes in output density (color), feedback control is also generally widely performed. More specifically, patch images are formed on an image carrier or a transfer body, and the densities of the patch images are measured by, for example, a photosensor, thereby performing control so that the output density (color) matches a target density (color). However, in feedback control, after the patch images are measured, a tone correction table is generated, and a tone conversion process is then performed for an input image, so a control time delay occurs. This makes it impossible to use feedback control to suppress fluctuations in density in a short cycle.

To suppress fluctuations in density in a short cycle, Japanese Patent Laid-Open No. 2001-42613 proposes a technique of estimating the charge amount of toner particles and controlling the contrast potential in image formation in real time.

Unfortunately, even when the above-mentioned image forming apparatus which performs tone calibration estimates the charge amount of toner and controls the contrast potential, the following problem is posed.

First, the amount of toner applied on a solid image is determined by the contrast potential and the charge amount of toner particles. More specifically, the amount of applied toner is proportional to the contrast potential and is inversely proportional to the charge amount of toner particles. Note that a change in developing capacity due to a temporal change of, for example, a developer need not be taken into consideration because it does not occur in the short term. Therefore, even when the contrast potential is set such that the amount of applied toner becomes appropriate by tone calibration, if the charge amount of toner particles then increases, the density lowers given a constant contrast potential. Note that if the increase in charge amount is large, it may be impossible to ensure a contrast potential which compensates for the decrease in density. Also, the conversion value for each tone of the reference tone conversion table depends on the contrast potential. Accordingly, when the contrast potential is increased to compensate for the decrease in density, the reference tone conversion table naturally shifts from an appropriate value. In this case, the error becomes large in a region having low to medium densities.

SUMMARY OF THE INVENTION

The present invention provides an image forming apparatus capable of bringing the output density close to a target density even if the charge amount of toner particles changes.

According to one aspect of the present invention, an image forming apparatus includes an image forming unit, which includes an image carrier, and a developing unit configured to develop toner particles on the image carrier; a storage unit configured to store a saturation charge amount of the toner particles, and a control unit. The control unit is configured to form a patch image using the image forming unit, measure a density of the patch image to obtain a first potential that is a contrast potential corresponding to a target density, estimate a charge amount of the toner particles in the developing unit to obtain a first charge amount, obtain a second potential from the first potential, the first charge amount and the saturation charge amount, and set the second potential as the contrast potential.

Further features of the present invention will become apparent from the following description of exemplary embodiments with reference to the attached drawings.

DESCRIPTION OF THE EMBODIMENTS

Figure 1:
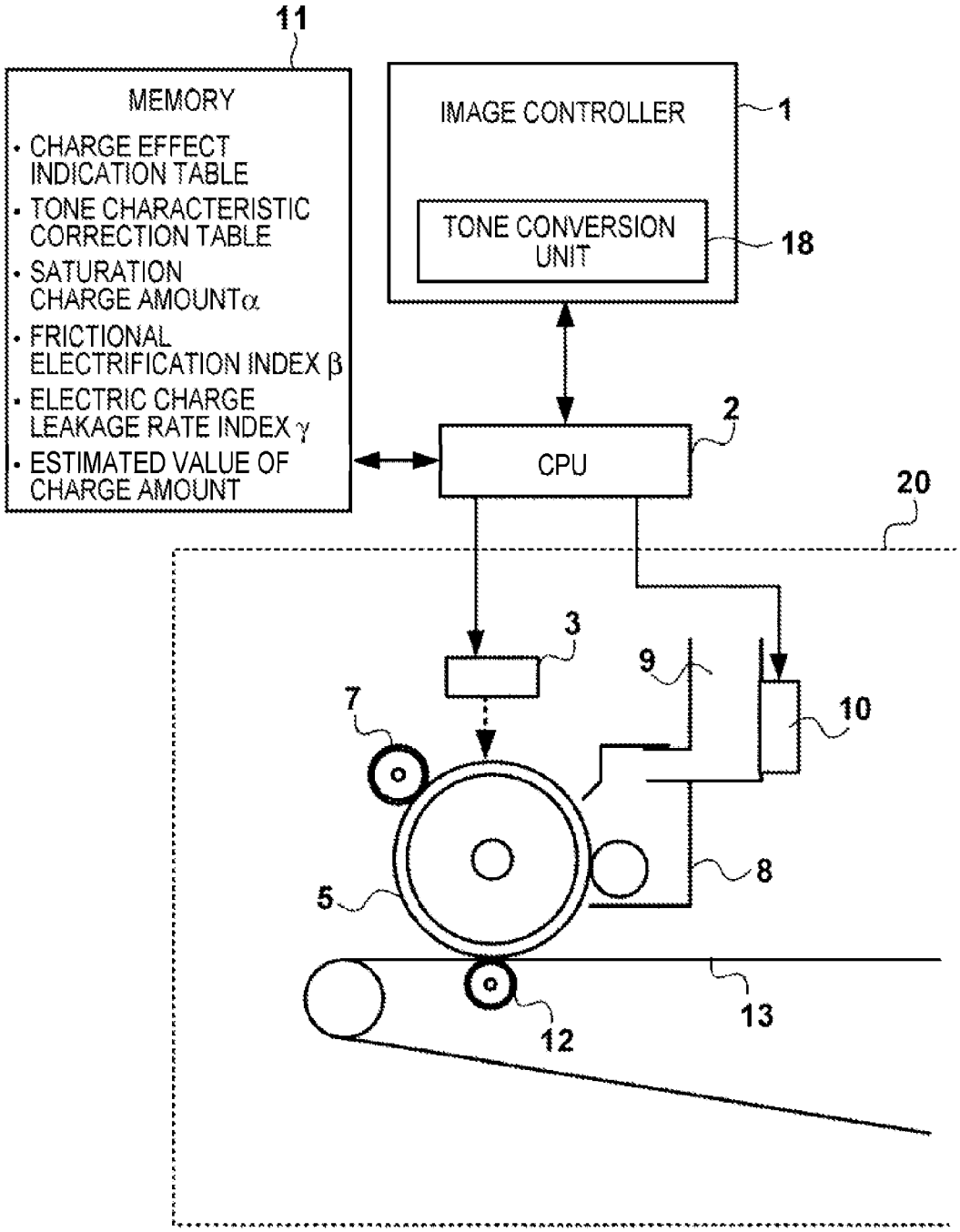
FIG. 1 is a block diagram showing the schematic configuration of an image forming apparatus according to an embodiment of the present invention.

An embodiment of the present invention will be described in detail below with reference to the accompanying drawings. An image forming apparatus according to the present embodiment will be described first. An image controller 1 of the image forming apparatus generates image forming data from image information which is described in a specific descriptive language and received from, for example, a host computer (not shown), as shown in FIG. 1. At this time, a tone conversion unit 18 of the image controller 1 performs tone conversion for an output image based on the estimated charge amount and saturation charge amount of toner particles, and a tone characteristic correction table, as will be described later.

Note that the tone characteristic correction table is generated by executing tone calibration by a control unit (CPU) 2, as will be described later.

Upon receiving the image forming data, the CPU 2 controls an exposure unit 3 of an image forming unit 20 to irradiate a photosensitive drum 5 serving as an image carrier with laser light corresponding to the image forming data. The photosensitive drum 5 is charged to a predetermined potential by a charging unit 7, and the potential of the portion that is irradiated with light changes. Thus, an electrostatic latent image is formed on the photosensitive drum 5. This embodiment employs a reversal developing system which negatively charges the photosensitive drum 5 and toner particles to make the toner particles adhere to the portion (light portion) irradiated with light. The amount of toner applied on a solid portion can be adjusted by controlling the intensity (amount) of light guided from the exposure unit 3 to the photosensitive drum 5.

A developing device includes a developer container 9 which stores a developer containing toner and carrier, and a developing unit 8 including an internal developing roller, and only toner in the developer is made to adhere to the photosensitive drum 5 by the developing roller applied with a developing bias. Thus, an electrostatic latent image is visualized into a toner image. The toner in the developer container 9 is resupplied to the developing unit 8 by driving a toner replenishing motor 10 as needed by the CPU 2. Note that the difference between the developing bias and the potential of the light portion on the photosensitive drum 5 is the contrast potential, which is set by adjusting the light illumination intensity and the developing bias by the CPU 2.

After the toner image on the photosensitive drum 5 is transferred onto an intermediate transfer belt 13 by a primary transfer device 12, it is further transferred onto a recording material by a secondary transfer device (not shown). Note that FIG. 1 illustrates only one set of a photosensitive drum 5, exposure unit 3, charging unit 7, primary transfer device 12, and developing device of the image forming unit 20, for the sake of simplicity. However, in practice, a plurality of sets of a photosensitive drum 5, exposure unit 3, charging unit 7, primary transfer device 12, and developing device are provided in the image forming unit 20 in correspondence with respective colors (yellow, magenta, cyan, and black). The image forming apparatus also includes a measuring unit (not shown) configured to measure the density of a patch image printed on a recording material. Note that the measuring unit may measure the density of a patch image formed or transferred on the photosensitive drum 5 or intermediate transfer belt 13. The image forming apparatus moreover includes various constituent elements that are not shown because they are unnecessary for understanding of the present invention.

In this embodiment, the CPU 2 estimates charge amounts Q of toner particles in the developing unit 8 at a predetermined time interval T in accordance with:

When Developing Roller is Rotated $$Q = Q_p\left(1 - \frac{T}{\alpha} - \frac{C}{M}\right) + \frac{\beta \cdot T}{\alpha} + Q_p$$

When Developing Roller is Stopped $$Q = Q_p \cdot (1-\gamma)$$

and stores them in a memory (storage unit) 11, where M is the amount of toner in the developing unit 8, $Q_p$ is the estimated charge amount of toner particles in the developing unit 8, which is obtained in the previous calculation operation, and C is the amount of toner consumed after the previous calculation operation. Note that the initial value of the charge amount of toner particles is set to, for example, 80 percent of the saturation charge amount. Also, $\alpha$ is the saturation charge amount of toner particles in the use environment, and has a value based on the lower limit of the ratio of toner to carrier, and an actual measurement value obtained in a minimum saturation humidity environment during a continuous operation. Moreover, $\beta$ is an index indicating the rate of frictional electrification, that is, an anti-static process, and $\gamma$ is an index indicating the rate of leakage of electric charge from the toner particles. These values $\alpha$, $\beta$, and $\gamma$ are determined in accordance with the toner charge characteristics and stored in the memory 11 in advance. Note that the amount of toner M in the developing unit 8 can be calculated based on, for example, the amount of toner consumption and the amount of toner replenishment. Note that other computational formulae which estimate the charge amount of toner particles in the developing unit 8 may also be adopted.

In executing image formation or tone calibration, the CPU 2 reads out the latest estimated value of the charge amount from the memory 11, and uses it as the estimated value of the charge amount at the time of each process. However, estimating the charge amount of toner particles, for example, can be performed every time image formation or tone calibration is executed.

Note that the memory 11 further stores a charge effect indication table indicating an effect that a change in charge amount of toner particles exerts on the density of each tone or the amount of applied toner. In other words, the charge effect indication table indicates the amount of correction for the density or the amount of applied toner, which is defined to compensate for a change in charge amount of toner particles so as to maintain the density of each tone constant. Note that the charge effect indication table is determined in advance based on the properties of the toner used.

A tone calibration process will be described next. In tone calibration, the CPU 2 determines a contrast potential to generate a tone characteristic correction table at the determined contrast potential. Note that the CPU 2 starts tone calibration when a predetermined condition is satisfied, such as after apparatus power-on or after completion of printing on a predetermined number of sheets.

Figure 2:
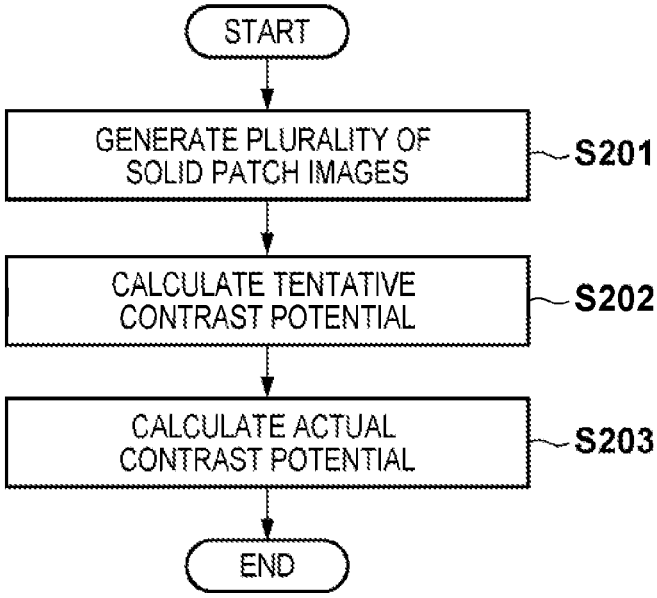
FIG. 2 is a flowchart of a contrast potential determination process in tone calibration according to the embodiment.

A contrast potential determination process by the CPU 2 will be described first with reference to FIG. 2. In step S201, the CPU 2 controls the image forming unit 20 to form a plurality of solid patch images by changing the exposure intensity so that the contrast potential changes while maintaining the potential of a dark portion constant. In step S202, the CPU 2 calculates a tentative contrast potential (first potential) by linear interpolation from the patch density of each solid patch image, which is measured by the measuring unit (not shown). The amount of applied toner O corresponding to a target density is inversely proportional to the latest estimated charge amount (first charge amount) Q1 of toner particles, stored in the memory 11, and is proportional to the contrast potential, so the tentative contrast potential Vt, the amount of applied toner O, and the charge amount Q1 satisfy a relation:

$$O = k \cdot Vt / Q1 \quad (1)$$

where k is a proportionality constant.

In step S203, the CPU 2 calculates a contrast potential (second potential) Vs to be set actually, based on the tentative contrast potential obtained in step S202, and the saturation charge amount a of toner particles in the use environment stored in the memory 11 and charge amount Q1. More specifically, the contrast potential Vs is calculated by modifying the tentative contrast potential Vt in accordance with:

$$Vs=Vt\cdot\alpha/Q1 \quad (2)$$

Substituting equation (2) into equation (1) yields:

$$O=k\cdot Vs/\alpha \quad (3)$$

where $\alpha$ is the saturation charge amount, that is, the maximum value of the charge amount of toner particles in the use environment. Therefore, the use of the contrast potential Vs makes it possible to prevent the situation in which the target density cannot be attained, even if the charge amount of toner particles becomes larger in image formation than in tone calibration.

Figure 3:
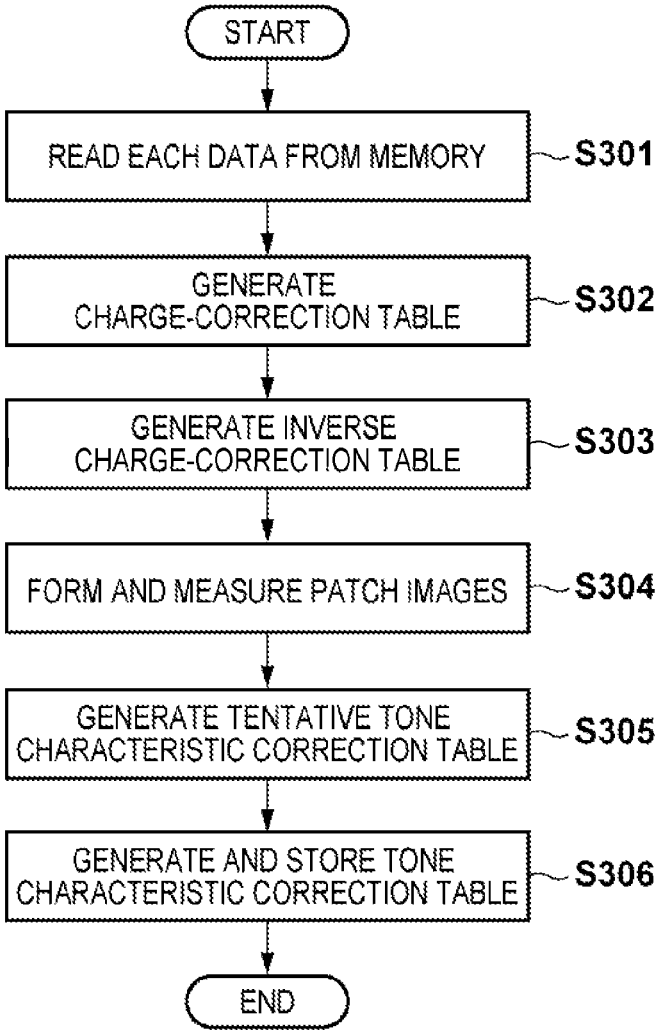
FIG. 3 is a flowchart of a tone characteristic correction table generation process in tone calibration according to the embodiment.

Generation of a tone characteristic correction table by the CPU 2 will be described next with reference to FIG. 3. Note that the process shown in FIG. 3 is done after the contrast potential Vs obtained by the process shown in FIG. 2 is set. In step S301, the CPU 2 reads the charge effect indication table, the saturation charge amount $\alpha$, and the latest estimated charge amount Q1 of toner particles from the memory 11. In step S302, the CPU 2 modifies the charge effect indication table to generate a charge-correction table (intermediate table). More specifically, the CPU 2 obtains a charge-correction table by multiplying the value of each tone in the charge effect indication table by (Q1/$\alpha$−1). Note that to adjust the correction scale, a predetermined value (first value) S can be added to the product obtained by multiplying the value of each tone in the charge effect indication table by (Q1/$\alpha$−1). Note also that when the value S is used, it is stored in the memory 11. In step S303, the CPU 2 generates an inverse charge-correction table from the charge-correction table. More specifically, the CPU 2 generates an inverse charge-correction table by obtaining the inverse of the value of each tone in the charge-correction table, and determining the obtained inverse as the value of the corresponding tone of the inverse charge-correction table. In other words, the products of the values of corresponding tones in the inverse charge-correction table and charge-correction table are all 1.

Figure 5:
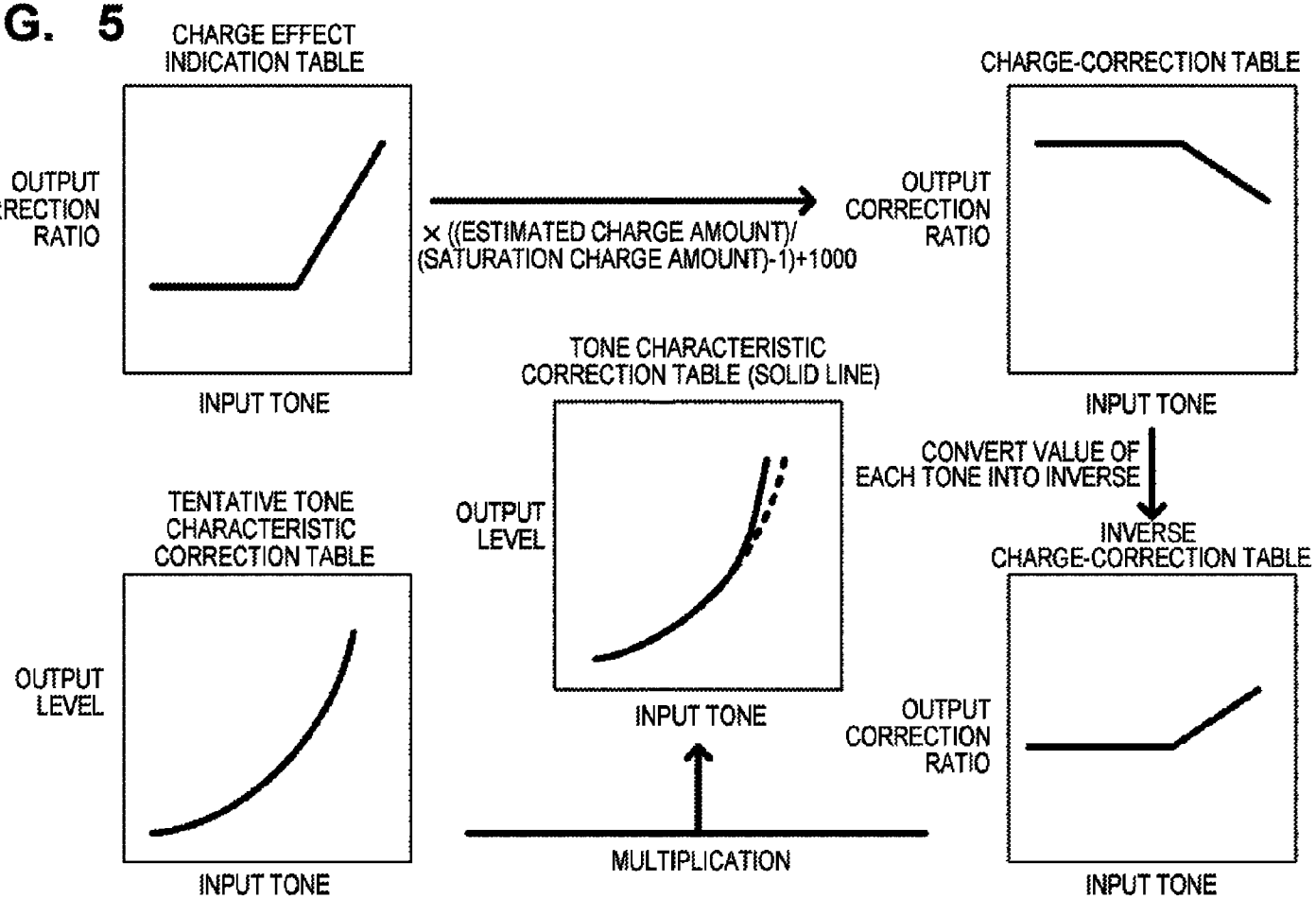
FIG. 5 shows graphs representing the relationship among tables generated by tone calibration according to the embodiment.

In step S304, the CPU 2 controls the image forming unit 20 and the measuring unit to form a plurality of patch images corresponding to respective tones and measure their densities. In step S305, the CPU 2 generates a tentative tone characteristic correction table (first correction table) based on the measurement result obtained in step S304. The generation of a tentative tone characteristic correction table is the same as the generation of a reference tone conversion table in the prior art technique. Lastly, in step S306, the CPU 2 multiplies the values of corresponding tones in the tentative tone characteristic correction table and inverse charge-correction table to generate a tone characteristic correction table (second correction table) according to the present embodiment. The CPU 2 stores the generated tone characteristic correction table in the memory 11. FIG. 5 shows the relationship among the above-mentioned tables. Note that in the tone characteristic correction table shown in FIG. 5, a dotted line indicates the relationship of the input/output of the tentative tone characteristic correction table, and a solid line indicates that of the tone characteristic correction table. Also, referring to FIG. 5, S=1000 is added in generating a charge-correction table. As is apparent from FIG. 5 and the above description, the charge-correction table is modified such that the amount of correction of each tone of the charge effect indication table reduces as the ratio of the estimated charge amount to the saturation charge amount increases.

Figure 4:
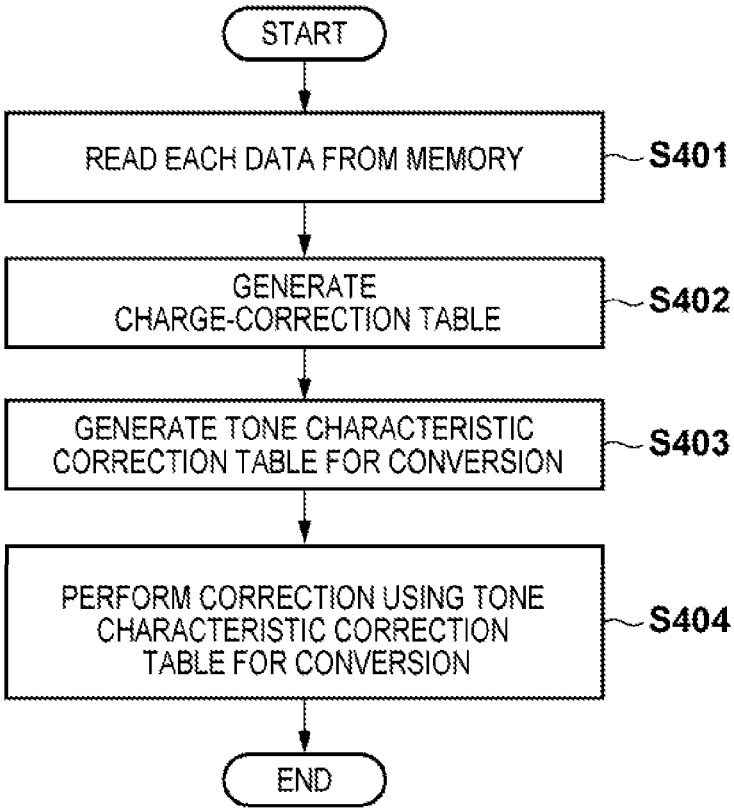
FIG. 4 is a flowchart of an image forming process according to the embodiment.
Figure 6:
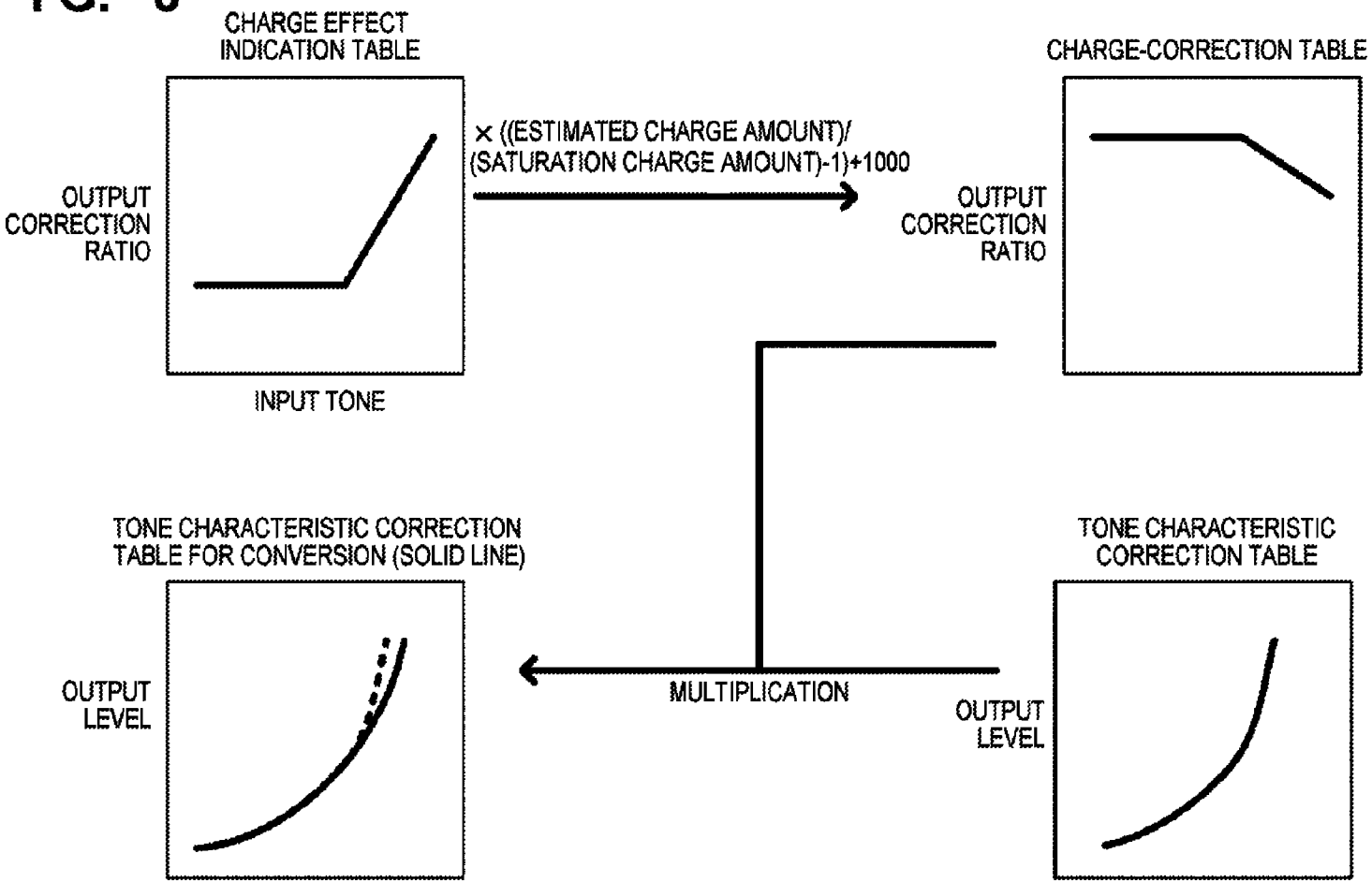
FIG. 6 shows graphs representing the relationship of tables used in image formation according to the embodiment.

A correction process in normal image formation will be described next with reference to FIG. 4. In step S401, the CPU 2 reads the charge effect indication table, the saturation charge amount $\alpha$, the latest charge amount (second charge amount) Q2 of toner particles, and the tone characteristic correction table from the memory 11. The tone characteristic correction table is generated by the previous calibration operation, and stored in the memory 11. In step S402, the CPU 2 generates a charge-correction table from the charge effect indication table. More specifically, the CPU 2 obtains a charge-correction table by multiplying the value of each tone in the charge effect indication table by (Q2/$\alpha$−1). Note that if the value S is added to adjust the scale in step S302, it is added in step S402 as well. In step S403, the CPU 2 multiplies the values of corresponding tones in the tone characteristic correction table and charge-correction table to generate a tone characteristic correction table for conversion (third correction table), and outputs it to the tone conversion unit 18. In step S404, the tone conversion unit 18 performs tone correction for an image formed in accordance with the tone characteristic correction table for conversion. FIG. 6 shows the relationship among the tables used in image formation. Note that in the tone characteristic correction table for conversion shown in FIG. 6, a dotted line indicates the relationship of the input/output of the tone characteristic correction table, and a solid line indicates that of the tone characteristic correction table for conversion. Referring to FIG. 6, S=1000 is added in generating a charge-correction table, like FIG. 5.

Assume, for example, that the charge amount of toner particles in image formation is equal to that in tone calibration. As can be seen from FIGS. 5 and 6, the tone characteristic correction table for conversion in that case is identical to the tentative tone characteristic correction table obtained by measuring the density of each patch image in calibration. In this embodiment, the tone characteristic correction table is multiplied by the charge-correction table obtained from the charge amount of toner particles in image formation, thereby making it possible to correct each tone corresponding to a change in charge amount after calibration, without changing the contrast potential.

As described above, setting a contrast potential using the saturation charge amount of toner particles makes it possible to prevent generation of a range in which density control is impossible due to a change in charge amount of toner particles. Also, a tone characteristic correction table is generated by modifying the amount of correction of each tone obtained by actual measurement, based on the saturation charge amount of toner particles in calibration. This allows correction corresponding to a change in charge amount of toner particles after calibration, without changing the contrast potential. More specifically, in image formation, the tone characteristic correction table is modified using the estimated charge amount of toner particles in the image formation to correct each tone, thereby allowing correction corresponding to a change in charge amount of toner particles after calibration.

While the present invention has been described with reference to above-described embodiments, it is to be understood that the invention is not limited to the disclosed embodiments. It will of course be understood that this invention has been described above by way of example only, and that modifications of detail can be made within the scope of this invention.

This application claims the benefit of Japanese Patent Application No. 2010-261726, filed on Nov. 24, 2010, which is hereby incorporated by reference herein in its entirety.

What is claimed is:

1. An image forming apparatus comprising:

an image forming unit including an image carrier and a developing unit configured to develop toner particles on the image carrier;

a storage unit configured to store a saturation charge amount of the toner particles; and a control unit, wherein the control unit is configured to form a patch image using the image forming unit, measure a density of the patch image to obtain a first potential that is a contrast potential corresponding to a target density, estimate a charge amount of the toner particles in the developing unit to obtain a first charge amount, obtain a second potential from the first potential, the first charge amount and the saturation charge amount, and set the second potential as the contrast potential.

2. The apparatus according to claim 1, wherein the second potential is obtained by multiplying the first potential by the saturation charge amount to obtain a product, and dividing the product by the first charge amount.

3. The apparatus according to claim 1, wherein the control unit is further configured to, after the contrast potential is set, generate a first correction table, which is used to correct each of tones, by measuring a density of a patch image with each of the tones, and generate a second correction table by modifying the first correction table using the first charge amount and the saturation charge amount.

4. The apparatus according to claim 3, wherein the storage unit is configured to store a charge effect indication table indicating a correction amount for the density of each of the tones due to a change in charge amount of the toner particles, the control unit is further configured to generate an intermediate table indicating a correction amount of each of the tones from the correction amount of each of the tones in the charge effect indication table, generate an inverse charge-correction table by obtaining an inverse value of each of the tones in the intermediate table, and generate the second correction table by multiplying values of corresponding tones in the inverse charge-correction table and the first correction table, and the correction amount of each of the tones in the intermediate table is modified such that the correction amount of each of the tones in the charge effect indication table reduces as a ratio of the first charge amount to the saturation charge amount increases.

5. The apparatus according to claim 4, further comprising a tone conversion unit, wherein the control unit is configured to, in image formation, estimate a charge amount of the toner particles in the developing unit to obtain a second charge amount, and generate a third correction table by modifying the second correction table using the saturation charge amount and the second charge amount, and the tone conversion unit is configured to correct each of tones of an image formed using the third correction table.

6. The apparatus according to claim 5, wherein the control unit is further configured to generate a charge-correction table from the correction amount of each of the tones in the charge effect indication table, and generate the third correction table by multiplying values of corresponding tones in the charge-correction table and the second correction table, and the correction amount of each of the tones in the charge-correction table is modified such that the correction amount of each of the tones in the charge effect indication table reduces as a ratio of the second charge amount to the saturation charge amount increases.

* * * * *